United States Patent [19]

Tenbergen

[11] 4,102,781

[45] Jul. 25, 1978

[54] FLOTATION PROCESS

[75] Inventor: Reichel A. Tenbergen, Hanmer, Canada

[73] Assignee: The International Nickel Company, Inc., New York, N.Y.

[21] Appl. No.: 703,509

[22] Filed: Jul. 8, 1976

[30] Foreign Application Priority Data

Jan. 30, 1976 [CA] Canada ..... 244644

[51] Int. Cl.[2] ..... B03D 1/02

[52] U.S. Cl. ..... 209/166

[58] Field of Search ..... 209/166, 167

[56] References Cited

U.S. PATENT DOCUMENTS

| | | | |
|---|---|---|---|
| 2,176,896 | 10/1939 | Epstein | 209/166 X |
| 2,293,470 | 8/1942 | Mead | 209/166 |
| 3,072,256 | 1/1963 | Golte | 209/167 |
| 3,256,140 | 6/1966 | Poschmann | 209/166 X |
| 3,845,862 | 11/1974 | McGuire | 209/166 |
| 4,006,014 | 2/1977 | Gannon | 209/166 X |

FOREIGN PATENT DOCUMENTS

| | | | |
|---|---|---|---|
| 143,300 | 5/1935 | Austria | 209/166 |
| 2,175,174 | 8/1972 | France | 209/167 |

*Primary Examiner*—Robert Halper

*Attorney, Agent, or Firm*—E. C. MacQueen; R. J. Kenny; F. J. Mulligan, Jr.

[57] ABSTRACT

An improvement in the process of flotation of sulfide minerals from basic gangue involving employing in association with a collector an alkylamidohydroxylated quaternary amine salt.

5 Claims, No Drawings

FLOTATION PROCESS

The present invention is concerned with improving the efficiency of flotation of sulfide ores and more particularly with improving the efficiency of flotation of nickel-containing sulfidic materials from basic rocks.

The art and science of flotation separation of desirable minerals from unwanted gangue is well known and has been practiced in many forms since the beginning of the twentieth century. Very briefly, the separation is based upon making the surface of a desired mineral in finely ground condition in an aqueous slurry hydrophobic so that upon introduction of air a froth can be formed in which the desired mineral is concentrated. This froth is then skimmed off and ready for further processing. In practice, more than one stage is usually employed to separate mineral from the gangue. The stages are usually designated as roughing, scavenging, and cleaning. A good review of froth flotation is contained in the book "Froth Flotation" 50th anniversary volume published by the American Institute of Mining, Metallurgical and Petroleum Engineers New York 1962.

In flotation of sulfide minerals, the use of collectors is well known. Xanthates are common collectors and have the general formula of

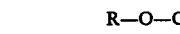

R—O—C—S—S—Me wherein R is an aliphatic radical and wherein Me is an alkali metal. Typical xanthates are amyl xanthates, butyl xanthates and isopropyl xanthates. Collectors can be used alone or in combination with activators and/or depressants to enhance or vary the selectivity of the flotation separation. It is also known to use xanthates in 1 to 1 molar association with simple quaternary amines as mixed collectors (see M. H. Buckenham et al Transactions Society of Mining Engineers, Vol. 226, March 1963, pages 1—6). Materials to aid froth formation, known as frothers, such as pine oil, methyl isobutyl carbinol (MIBC and otherwise known as methyl amyl alcohol or 4 methylpentanol-2) and proprietary products such as the Dowfroth products are commonly used.

Some considerable difficulty is encountered in flotation separation of sulfide minerals from basic rock types such as peridotite and serpentine and the associated alteration products. Some reagents which have been employed or suggested for employment in association with collectors for enhancement of separation of nickel sulfides from basic rock types include polyacrylamides, polycrylates, polysaccharides, cellulose compounds, tannin-rich compounds, soda ash, liquid $SO_2$, tetrasodium pyrophosphate, sodium silicates, etc. Applicant has now discovered that by combining a collector with a particular type of a complex amido-alkanol quaternary amine generally known as an antistatic agent for plastics, textiles, paper and dry powders an improved process for separating sulfide minerals from gangue can be provided.

It is an object of the present invention to provide a novel, useful flotation process for separating mineral sulfides from gangue.

It is a further object of the present invention to provide a novel useful flotation process for separating mineral sulfides from basic rock gangue.

Other objects and advantages will become apparent from the following description.

Generally speaking, the present invention contemplates in the flotation separation of a sulfide mineral from gangue in an aqueous medium having a basic pH, employing in association with a collector a material defined by the formula

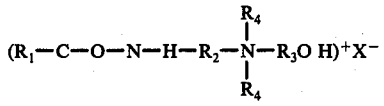

$$(R_1-C-O-N-H-R_2-\overset{\overset{R_4}{|}}{\underset{\underset{R_4}{|}}{N}}-R_3O\,H)^+X^-$$

wherein $R_1$ is an aliphatic or alicyclic radical containing at least 7 and up to about 20 carbon atoms $R_2$ is a moiety selected from the group of methylene, ethylene, propylene and butylene radicals $R_3$ is a moiety selected from the group of ethylene and propylene radicals $R_4$ is an aliphatic radical containing from 1 to 3 carbon atoms and X is a monavalent anion compatible in an ore pulp in an amount effective to enhance the separation of said sulfide mineral from said gangue.

The improvement provided by the present invention is most particularly applicable when the gangue comprises basic and ultra-basic type rock of the peridotite or serpentine varieties including associated alteration products. More particularly the improvement of the present invention relates to the separation of nickel-containing sulfidic materials from such basic rock type gangue.

The improved process of the present invention is operative with conventional type aqueous ore pulps having a basic pH, adjusted, if necessary, by means of a base such as lime, caustic or soda ash to a pH of about 9. The collector can be any one of those normally used in the art such as xanthates. The special material employed in the improved process of the present invention is exemplified by stearamidopropyldimethyl-B-hydroxyethylammonium nitrate sold in trade for antistatic purposes by American Cyanamid Company as Cyastat (R)SN Antistatic agent. This compound and homologues thereof useful in the improved process of the present invention are described in U.S. Pat. No. 2,626,878 of Jan. 27, 1953, to J. J. Carnes along with means of production thereof and the utility of such compounds of antistatic purposes. Homologues of Cyastat SN antistatic agent generally described as aliphatic amidopropyl quaternary ammonium salts and useful in the improved process of the present invention are also disclosed and claimed in U.S. Pat. No. 2,589,674 of Mar. 18, 1952, to E. W. Cook et al and stated to be useful as wetting agents, detergents, emulsifying agents, germicides, fungicides and the like.

The amount of Cyastat SN antistatic agent employed in the process of the present invention depends to a great extent upon the character of the ore and gangue being treated and the specific conditions of flotation. In general, amounts of Cyastat SN antistatic agent (and its close homologues) of the order of 0.01 to about 0.1 gram per kilogram of ore are sufficient to enhance the recovery of valuable minerals when treating nickel-containing sulfide ore. As those skilled in the art are aware it is common to add the collector in increments (i.e.,) during milling and prior to scavenging and cleaning.

The anti-static agent can likewise be added in increments depending upon the gangue type or can be used as a single addition prior to the rougher flotation stage. It is to be observed that the antistatic agents used in accordance with the present invention can be used in association with collectors, modifying agents, frothers, activators and depressants which are normally used for treatment of particular ore types under varying process restraints.

In order to give those skilled in the art a better understanding of the invention, the following examples are given.

EXAMPLE I

A basic nickel sulfide containing ore containing in percent by weight about 0.02% to 0.04% copper about 0.58% to 0.68% nickel and about 1.2% and 2% sulfur was wet ground in the presence of a conventional amount of amyl xanthate and sufficient soda ash to give a pulp pH of about 9. The wet ground feed was then introduced, along with a conventional amount of MIBC to a flotation operation involving a 3-minute rougher treatment, a 3-minute scavenger treatment and a 4-minute cleaning treatment. Coventional additions of MIBC and amyl xanthate were also made prior to scavenging and cleaning. Test A was run exactly as described. Test B added 0.05 gram of carboxymethyl cellulose (CMC) per kilogram of ore prior to the rougher stage and Test C added 0.05 gram of Cyastat SN per kilogram of ore prior to the rougher stage. The results in terms of composition of cleaner concentrate and combined tailings (scavenger and cleaner tailings) show the effectiveness of Cyastat SN as an inherent part of the process of the present invention and are set forth in Table I.

TABLE 1

| | | Cleaner Concentrate | | Recovery | | Combined Tailings |
|---|---|---|---|---|---|---|
| Test | Additive | %Ni | %S | Wt% | % Ni | %Ni |
| A | None | 1.82 | 2.3 | 5.3 | 15.7 | 0.55 |
| B | CMC | 1.78 | 2.7 | 8.9 | 25.7 | 0.51 |
| C | Cyastat SN | 4.64 | 8.2 | 8.7 | 70.5 | 0.19 |

EXAMPLE II

An additional test identical to Test C except that isopropyl xanthate was employed as additions to rougher, scavenger and cleaner stages in place of the amyl xanthate added to the scavenger and cleaner stages produced results essentially similar to the results of Test C except that the nickel recovery in the cleaner concentrate was a higher (i.e., 77%) and the nickel content of the tailings was a little lower (i.e., 0.17%).

EXAMPLE III

Another series of tests similar to the series in Example I was run using no additive, a polyacrylate additive and Cyastat SN on a basic, nickel sulfide ore containing 0.03% to 0.04% copper, 0.59% to 0.63% nickel and 1.6% sulfur. The results which again show the complete superiority of the Cyastat SN additive are set forth in Table II.

TABLE II

| | | Cleaner Concentrate | | | | Combined Tailings | |
|---|---|---|---|---|---|---|---|
| | | | | Recovery | | | |
| Test | Additive | %Ni | %S | %Wt | %Ni | %Ni | %S |
| E | None | 1.24 | 2.4 | 5.1 | 10.8 | 0.55 | 1.6 |
| F | Polyacrylate | 3.02 | 3.9 | 5.1 | 25.4 | 0.48 | 1.4 |
| G | Cyastat SN | 10.30 | 21.4 | 5.1 | 84.3 | 0.10 | 0.6 |

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. In the flotation separation of a sulfide mineral from gangue employing a xanthate collector in an aqueous medium having a basic pH, the improvement comprising employing in association with said xanthate collector a material defined by the formula $$(R_1CONHR_2\overset{\overset{R_4}{|}}{\underset{\underset{R_4}{|}}{N}}-R_3OH)^+X^-$$

wherein $R_1$ is an aliphatic or alicyclic radical containing at least 7 and up to about 20 carbon atoms $R_2$ is a moiety selected from the group of methylene, ethylene, propylene and butylene radicals $R_3$ is a moiety selected from the group of ethylene and propylene radicals $R_4$ is an aliphatic radical containing from 1 to 3 carbon atoms and X is a monavalent anion compatible in an ore pulp in an amount effective to enhance the separation of said sulfide mineral from said gangue.

2. A process as in claim 1 wherein the gangue is essentially a basic rock gangue.

3. A process as in claim 1 wherein the sulfide mineral contains nickel.

4. A process as in claim 1 wherein the material defined by the formula is an aliphatic amido propyl quaternary ammonium salt.

5. A process as in claim 1 wherein the material defined by the formula is stearamidopropyldimethyl-B-hydroxy-ethyl ammonium nitrate.

* * * * *